US008876557B2

(12) United States Patent
Xu

(10) Patent No.: US 8,876,557 B2
(45) Date of Patent: Nov. 4, 2014

(54) REPLACEABLE BRACKET LAMP TUBE AND LAMP HEAD COVER

(75) Inventor: Xiaoliang Xu, Shanghai (CN)

(73) Assignee: Shanghai Yaming Lighting Co., Ltd., Jiading District, Shanghai (CN)

( * ) Notice: Subject to any disclaimer, the term of this patent is extended or adjusted under 35 U.S.C. 154(b) by 51 days.

(21) Appl. No.: 13/824,998

(22) PCT Filed: Nov. 26, 2010

(86) PCT No.: PCT/CN2010/079163

§ 371 (c)(1),
(2), (4) Date: Mar. 18, 2013

(87) PCT Pub. No.: WO2012/040967

PCT Pub. Date: Apr. 5, 2012

(65) Prior Publication Data

US 2013/0182426 A1 Jul. 18, 2013

(30) Foreign Application Priority Data

Sep. 28, 2010 (CN) ..... 2010 1 0295913

(51) Int. Cl.

| | |
|---|---|
| ***H01K 1/00*** | (2006.01) |
| ***H01R 33/96*** | (2006.01) |
| ***F21V 25/04*** | (2006.01) |
| ***F21K 99/00*** | (2010.01) |
| ***F21V 23/06*** | (2006.01) |
| ***H01H 13/32*** | (2006.01) |

(52) U.S. Cl.

CPC ..... *F21V 23/06* (2013.01); *H01R 33/96* (2013.01); *F21V 25/04* (2013.01); *F21K 9/175* (2013.01); *H01H 13/32* (2013.01)

USPC ..... 439/619

(58) Field of Classification Search

USPC ..... 439/612, 619; 313/318.02, 318.05, 313/318.12

See application file for complete search history.

(56) References Cited

U.S. PATENT DOCUMENTS 5,898,264 A * 4/1999 Nose et al. ..... 313/477 HC
5,904,415 A * 5/1999 Robertson et al. ..... 362/260
5,932,956 A * 8/1999 Dietze ..... 313/318.07

(Continued)

*Primary Examiner* — Ross Gushi

(74) *Attorney, Agent, or Firm* — Tianhua Gu; Global IP Services

(57) ABSTRACT

A bracket lamp tube and a lamp head cover thereon are provided. The lamp head cover comprises a cover body (2) and a metallic needle (1) penetrating the cover body (2). The front end of the metallic needle (1) extends out of the outside of the cover body (2). The rear end of the metallic needle (1) is located inside the cover body (2) and is fixedly connected to a first metallic contact plate (3). A second metallic contact plate (5) separated from the first metallic contact plate (3) is provided inside the cover body (2). A third metallic contact plate (6) is provided between the first and the second metallic contact plates (3, 5) and is connected to a touch button (4). The touch button (4) is exposed outside the cover body (2). The first and the second metallic contact plates (3, 5) are electrically connected by the third metallic contact plate (6) as the touch button (4) is pressed. The metallic needle (1) and an internal ballast are disconnected when the lamp head cover is not connected to the lamp, and the L and the N poles of the ballast are connected for power supply by using the connection of the first and the second metallic contact plates (3, 5) when the lamp head cover is installed to a lamp socket.

12 Claims, 4 Drawing Sheets

(56) References Cited

U.S. PATENT DOCUMENTS

| | | | | |
|---|---|---|---|---|
| 6,239,539 | B1 * | 5/2001 | Mochiduki et al. | 313/318.01 |
| 6,239,540 | B1 * | 5/2001 | Wittmann | 313/318.09 |
| 7,291,029 | B2 * | 11/2007 | Hale et al. | 439/236 |
| 7,484,980 | B2 * | 2/2009 | Liao | 439/236 |
| 7,540,761 | B2 * | 6/2009 | Weber et al. | 439/487 |
| 7,619,352 | B2 * | 11/2009 | Jeurissen et al. | 313/485 |
| 8,118,447 | B2 * | 2/2012 | Simon et al. | 362/235 |
| 8,123,540 | B2 * | 2/2012 | Galluccio et al. | 439/241 |
| 8,232,713 | B2 * | 7/2012 | Li et al. | 313/318.01 |
| 8,313,348 | B2 * | 11/2012 | Mertens et al. | 439/619 |
| 2002/0111070 | A1 * | 8/2002 | Nerone et al. | 439/612 |
| 2009/0200941 | A1 * | 8/2009 | Klinedinst | 313/565 |
| 2010/0015843 | A1 * | 1/2010 | Zayas et al. | 439/375 |
| 2010/0244653 | A1 * | 9/2010 | Schuck | 313/318.12 |
| 2013/0113362 | A1 * | 5/2013 | Gyulasi et al. | 313/490 |
| 2014/0111082 | A1 * | 4/2014 | Cohen et al. | 313/486 |

* cited by examiner

REPLACEABLE BRACKET LAMP TUBE AND LAMP HEAD COVER

CROSS REFERENCE TO RELATED PATENT APPLICATION

The present application is the US national stage of PCT/CN2010/079163 filed on Nov. 26, 2010, which claims the priority of the Chinese patent application No. 201010295913.2 filed on Sep. 28, 2010, which application is incorporated herein by reference.

BACKGROUND OF THE PRESENT INVENTION

1. Field of Invention

The present invention relates to illumination devices, and specifically to a replaceable bracket lamp tube and lamp head cover.

2. Description of Related Arts

A replaceable bracket lamp (including an LED replaceable bracket lamp) can directly replace an original lamp tube. For example, to replace a T5 bracket lamp with a T8 bracket lamp, it is only required to replace a T5-type lamp tube with a T8-type lamp tube. In this way, the illumination energy can be saved and complex construction is not required, so the replaceable bracket lamp is a convenient, quick, and economic illumination lamp.

At present, an existing replaceable bracket lamp mainly includes a lamp tube, electronic ballast is arranged in the lamp tube, and lamp head covers are located at two ends of the lamp tube. Electrodes are arranged in the lamp head covers and connected to an L line and an N line of the electronic ballast respectively. A metallic needle is arranged on the lamp head cover and is connected to a lamp socket. When the two ends of the lamp tube is installed into the lamp sockets, the lamp socket at one end is connected to the metallic needle and the electrode at the one end, then to the L electrode and the N electrode of the electronic ballast, and then to the electrode, the metallic needle, and the lamp socket at the other end, thereby forming a current loop. In the existing lamp head cover, the internal electrode is directly connected to the external metallic needle. This design brings a potential hazard to installation, because installation personnel probably do not connect the two ends of the replaceable lamp tube into the lamp sockets at the same time during installation. Suppose two ends of the lamp tube are connected into the lamp sockets asynchronously, when one end is connected to the lamp socket, the metallic needle and electrode at this end are connected to the lamp socket, and meanwhile, the electronic ballast in the lamp tube and the electrode at the other end are connected to the lamp socket. That is to say, at this time, the electronic ballast is connected in a power grid in series, so the metallic needle exposed at the other end is unsafe. If the installation personnel carelessly touch the metallic needle not inserted into the lamp socket, it is equivalent to that the personnel are connected to the L and N loop in series, so that the personnel get an electric shock.

SUMMARY OF THE PRESENT INVENTION

The technical solution to be solved in the present invention is to provide a lamp head cover of a bracket lamp, wherein the lamp head cover can be disconnected automatically, thereby preventing an electric shock and solving the disadvantages in the prior art.

The following technical solutions are adopted in the present invention:

Provided is a lamp head cover of a bracket lamp, comprising a cover body and metallic needles passing through the cover body, wherein a front end of the metallic needle extends outside the cover body, a rear end of the metallic needle is located inside the cover body, the rear end of the metallic needle is fixedly connected to a first metallic contact plate, a second metallic contact plate separated from the first metallic contact plate is further comprised inside the cover body, a third metallic contact plate is further arranged between the first metallic contact plate and the second metallic contact plate, the third metallic contact plate is connected to a touch button, the touch button is exposed outside the cover body, and when the touch button is pressed, the first metallic contact plate and the second metallic contact plate are electrically connected through the third metallic contact plate.

Preferably, the first and second metallic contact plates are on the same plane, and front surfaces of the first and second metallic contact plates contact a real surface of the third metallic contact plate at the same time.

Preferably, at a front end of the touch button is a pressing part with a rod portion, the pressing part is arranged in an inner cavity of a protrusion protruding on the cover body, a first pressure spring is sleeved on the rod portion, and the first pressure spring is held between a wall of the inner cavity of the protrusion and the pressing part.

Preferably, the touch button further comprises a screw connected in the rod portion of the pressing part, the third metallic contact plate, a second pressure spring, and a cushion ring are sleeved on a screw rod successively, an inner diameter of the cushion ring is less than an outer diameter of the rod portion of the pressing part, and the second pressure spring is set with a pretightening force.

Preferably, the shape of the inner cavity of the protrusion is matched with an outer surface of the pressing part.

Preferably, the third metallic contact plate, the second pressure spring, and the cushion ring are movably sleeved on the screw rod.

Preferably, the number of metallic needles is two.

Preferably, first and second lateral columns opposite each other and a third lateral column are arranged inside the cover body, the metallic needles are arranged in the first and second lateral columns, two ends of the first metallic contact plate are bent and are connected to corresponding lateral columns respectively, and the second metallic contact plate is arranged at a rear end of the third lateral column.

Preferably, the second metallic contact plate is connected to an electrode of ballast in a lamp tube.

Preferably, further comprised is a fourth lateral column, opposite the third lateral column, and a middle portion of the first metallic contact plate is headed by the fourth lateral column.

Preferably, the outer surface of the pressing part is a smooth cambered surface.

According to the lamp head cover involved in the present invention, when a lamp is not connected, the metallic needle and the internal ballast are disconnected, and after the lamp is installed into the lamp socket, the L and N electrodes of the ballast are connected by connecting the first and second metallic contact plates in the lamp head cover, so as to supply electricity. The arrangement of the spring can ensure the reliability of the contact and prevent poor contact caused by errors generated by different sizes of different lamps.

Another technical solution to be solved in the present invention is to provide a lamp tube of a bracket lamp, wherein when the lamp tube is installed, the lamp head cover can be disconnected automatically, thereby preventing an electric shock and solving the disadvantages in the prior art.

The following technical solutions are adopted in the present invention:

Provided is a lamp tube of a bracket lamp, wherein a lamp head cover is arranged at each of two ends of the lamp tube, the lamp head cover comprises a cover body and metallic needles passing through the cover body, a front end of the metallic needle extends outside the cover body, a rear end of the metallic needle is located inside the cover body, the rear end of the metallic needle is fixedly connected to a first metallic contact plate, a second metallic contact plate separated from the first metallic contact plate is further comprised inside the cover body, the second metallic contact plate is connected to an electrode of ballast in the lamp tube, a third metallic contact plate is further arranged between the first metallic contact plate and the second metallic contact plate, the third metallic contact plate is connected to a touch button, the touch button is exposed outside the cover body, and when the touch button is pressed, the first metallic contact plate and the second metallic contact plate are electrically connected through the third metallic contact plate.

The lamp tube of the bracket lamp involved in the present invention is provided with the lamp head cover, so that during installation, the first and second metallic contact plates in the lamp head cove inserted into the lamp socket are electrically connected through the third metallic contact plate, then the two electrodes of the ballast are connected, the other end is not inserted into the lamp socket, the first and second metallic contact plates at this end are not connected, so the metallic needle is not electrified, thereby eliminating a potential safety hazard.

DETAILED DESCRIPTION OF THE PREFERRED EMBODIMENTS

Figure 1:
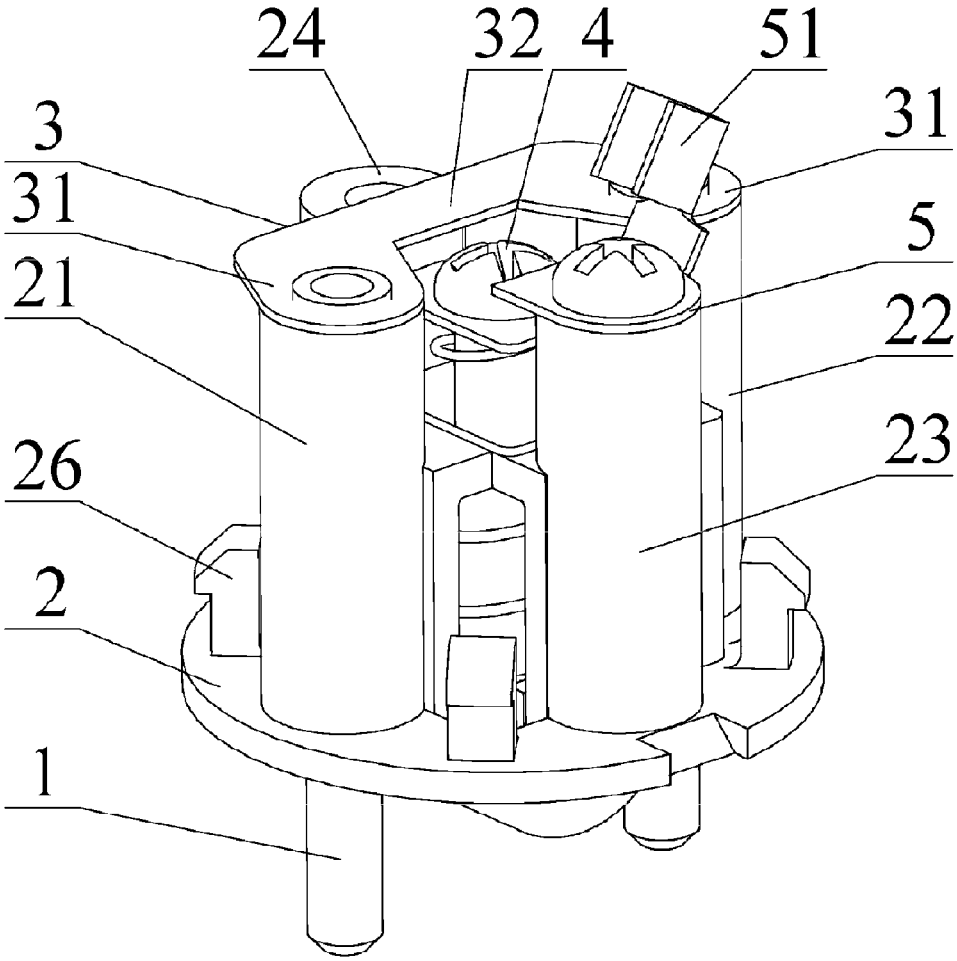
FIG. 1 is a schematic structural view of a lamp head cover of a bracket lamp involved in the present invention.

FIG. 1 is a schematic structural view of a lamp head cover of a bracket lamp involved in the present invention. The lamp head cover includes a lamp head cover body. The lamp head cover body includes a cover body 2 and lateral columns. The lateral column includes first, second, third, and fourth lateral columns 21 to 24. A metallic needle 1 is arranged in each of the first and second lateral columns 21 and 22. The metallic needle 1 penetrates the lateral column. A front end of the metallic needle 1 extends outside the cover body. The metallic needle 1 is fixedly connected to a first metallic contact plate 3. Referring to FIG. 1, the metallic needles 1 pass through the lateral columns 21 (22) and are riveted so that heads of the metallic needle 1 form turnups, thereby fixing the first metallic contact plate 3. The first lateral column 21 is opposite the second lateral column 22 and the third lateral column 23 is opposite the fourth lateral column 24. Two ends 31 of the first metallic contact plate 3 are bent, a middle portion 32 bypasses a central region of the lamp head cover body and is headed by the fourth lateral column 24. A real end of the third lateral column 23 is fixed to a second metallic contact plate 5 through a nut. The second metallic contact plate 5 includes a contact piece body and an electrode end 51 connected to a lead at an end of electronic ballast. The body of the second metallic contact plate 5 and the first metallic contact plate 3 are on the same plane. In this embodiment, the first metallic contact plate, the second metallic contact plate, a third metallic contact plate are of the same material and the same thickness, so the first, second, and third, and fourth lateral columns 21 to 24 have the equal length.

Figure 2:
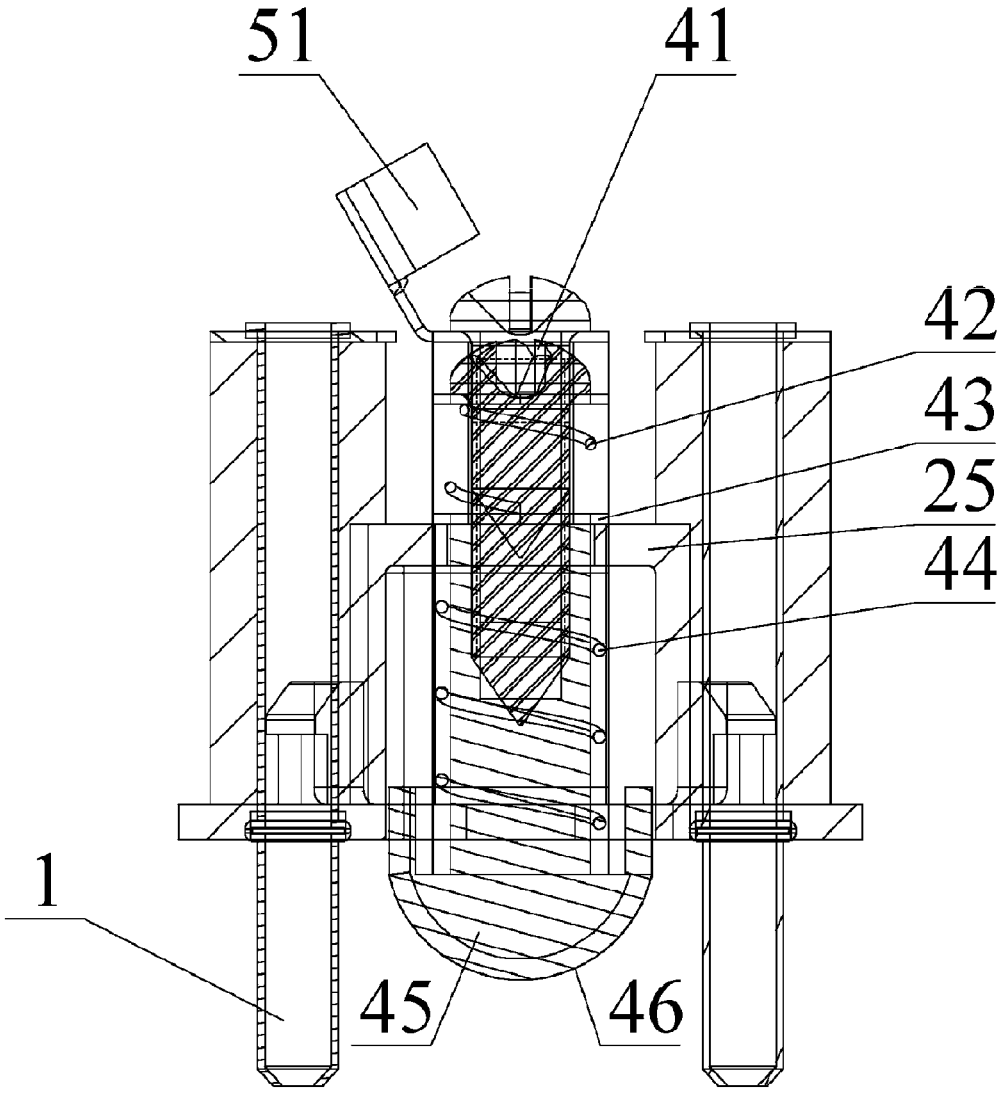
FIG. 2 is a partial sectional view of a lamp head cover of a bracket lamp involved in the present invention.
Figure 3:
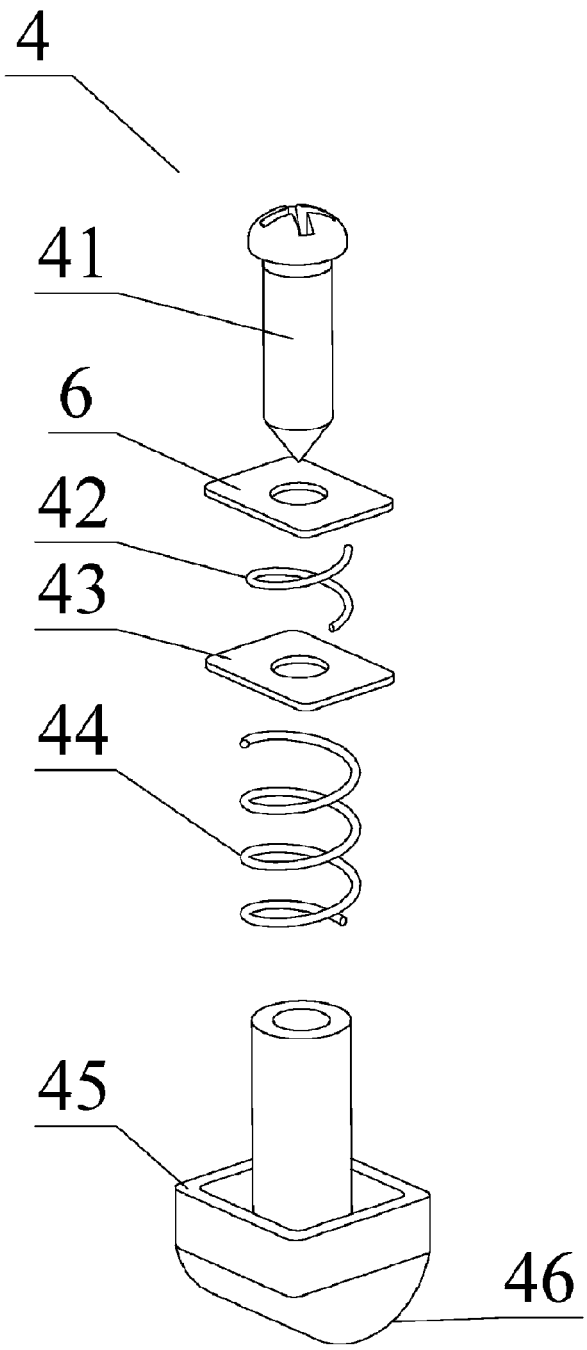
FIG. 3 is an exploded view of a center column component on a lamp head cover on a bracket lamp involved in the present invention.

FIG. 3 is an exploded view of a touch button 4 on the lamp head cover on the bracket lamp involved in the present invention. The touch button 4 includes a pressing part 45 with a rod portion and a self-tapping screw 41 inserted into the rod portion and engaged with the rod portion. A third metallic contact plate 6, a second pressure spring 42, a cushion ring 43, and a first pressure spring 44 are movably sleeved successively between a head portion of the screw and the pressing part 45. An inner diameter of the annular cushion ring 43 is less than an outer diameter of the rod portion. In this way, the cushion ring 43 (and the second pressure spring 42 and the third metallic contact plate 6 over the cushion ring 43) can only move along a screw rod, and the first pressure spring 44 can only work on the rod portion of the button 45. Referring to FIG. 2, a columnar protrusion 25 is arranged inwards in the center of the cover body 2, where a top of the protrusion 25 is provided with a through hole, and a diameter of the through hole is less than the outer diameter of the cushion ring 43 and greater than the outer diameter of the rod portion. The touch button component passes through the through hole to be installed to the lamp head cover body, and the pressing part 45 is exposed outside the cover body. The second pressure spring 42 is pressed between the third metallic contact plate 6 and the cushion ring 43, thereby generating a pretightening force. One end of the first pressure spring 44 is held against an inner cavity of the protrusion 25, the other end is held against an inner surface of the button 45, and the first pressure spring 44 is pressed to generate a pretightening force. Furthermore, the shape of the inner cavity of the protrusion 25 may be matched with an outer surface 46 of the pressing part 45, so that the pressing part 45 moves along a side wall of the inner cavity of the protrusion 25, thereby ensuring liner motion of the touch button 4. When the pressing part 45 is in an initial state, the third metallic contact plate 6 are separated from the first and second metallic contact plates 3 and 5; the pressing part 45 is pressed, the third metallic contact plate 6 moves towards the first and second metallic contact plates 3 and 5, until the third metallic contact plate 6 contacts the first and second metallic contact plates 3 and 5. Furthermore, the first pressure spring 44 is pressed at this time, so a reversed restoring force is generated. In order to make the three metallic contact plates 3, 5, and 6 fully contact one another, the area of the third metallic contact plate 6 should be moderate, so that the motion of the touch button 4 in the four lateral columns is not affected and front surfaces of the first and second metallic contact plates 3 and 5 can contact the third metallic contact plate 6.

Figure 5:
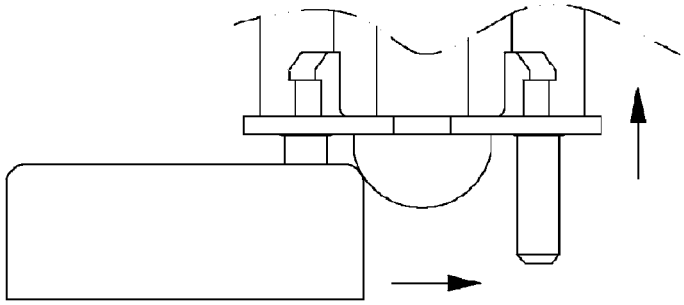
FIG. 5 is a schematic view of installation of a lamp head cover of a bracket lamp involved in the present invention and a lamp socket.

The lamp head cover is inserted into a lamp socket through the metallic needle 1. The lamp socket is provided with a groove for the metallic needle 1 to pass through. A surface of the lamp socket is a plane. A surface of the pressing part 45 may be a symmetric inclined surface or cambered surface, and in this embodiment, is preferably a smooth cambered plane. The metallic needle 1 is embedded in the groove and moves along a transverse direction shown in FIG. 5. When the surface of the pressing part 45 is pressed by the lamp socket, the third metallic contact plate 6 is driven to move along a longitudinal direction shown in FIG. 5. After the third metallic contact plate 6 contacts the first and second metallic contact plates 3 and 5, due to the action of the second pressure spring 42, the pressing part 45 can be still pressed until the lamp head cover is installed in place.

Figure 4:
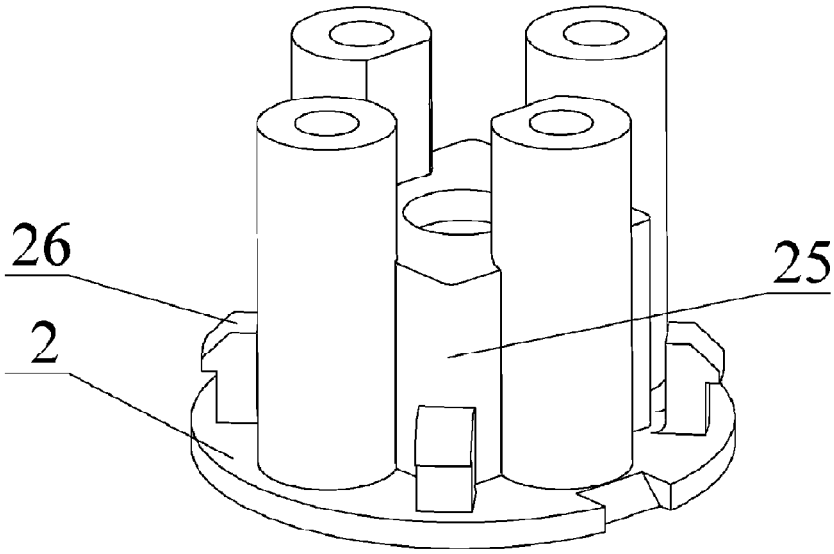
FIG. 4 is a schematic structural view of a lamp head cover body of a bracket lamp involved in the present invention.
Figure 6:
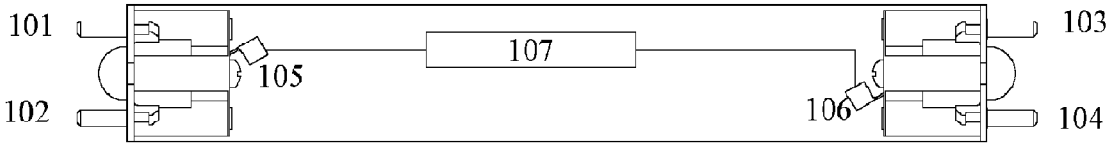
FIG. 6 is a schematic structural view of a lamp tube with each end installed with a lamp head cover of a bracket lamp involved in the present invention.

A lamp head cover is arranged at each of two ends of a lamp tube. A connection part 26 is arranged along an edge of the cover body (see in FIG. 4). The lamp head cover is connected to the connection part 26. Each component of the lamp head cover is enveloped in the lamp tube, and only the metallic needle is exposed out of the lamp tube. Referring to FIG. 6, when one end of the lamp tube is installed into the lamp socket, the lamp socket is connected to the metallic needles 101 and 102, and meanwhile, as the touch button is pressed, the third metallic contact plate contacts the first and second metallic contact plates. A current flows out of the lamp socket and reaches the first metallic contact plate through the metallic needles 101 and 102. At this time, the first and second metallic contact plates are electrically connected through the third metallic contact plate, so the current can reach the electrode end 105 and then reach the electrode end 106 at the other end of the lamp tube through the electronic ballast 107. The lamp head cover at the other end is not installed into the lamp socket, and the first metallic contact plate and the second metallic contact plate are disconnected, so the metallic needles 103 and 104 are not electrified, thereby not causing danger to an installation personnel. In the use process, the second pressure spring can regulate contact pressures between the third metallic contact plate and the other two metallic contact plates, so as to avoid the problem that the first and second metallic contact plates may deform so that the first and second metallic contact plates cannot fully contact the third metallic contact plate. Therefore, through the present invention, the work stability of the bracket lamp can be ensured, and no potential safety hazard exists when a lamp tube is replaced, so the operation and use is convenient.

What is claimed is:

1. A lamp head cover of a bracket lamp, comprising a cover body (2) and metallic needle (1) passing through the cover body (2), wherein a front end of the metallic needle (1) extends outside the cover body, a rear end of the metallic needle (1) is located inside the cover body, the rear end of the metallic needle (1) is fixedly connected to a first metallic contact plate (3), a second metallic contact plate (5) separated from the first metallic contact plate (3) is further comprised inside the cover body (2), a third metallic contact plate (6) is further arranged between the first metallic contact plate (3) and the second metallic contact plate (5), the third metallic contact plate (6) is connected to a touch button (4), the touch button (4) is exposed outside the cover body, and when the touch button (4) is pressed, the first metallic contact plate (3) and the second metallic contact plate (5) are electrically connected through the third metallic contact plate (6).

2. The lamp head cover of a bracket lamp as in claim 1, wherein the first and second metallic contact plates (3, 5) are on the same plane, and front surfaces of the first and second metallic contact plates (3, 5) contact a real surface of the third metallic contact plate (6) at the same time.

3. The lamp head cover of a bracket lamp as in claim 2, wherein at a front end of the touch button (4) is a pressing part (45) with a rod portion, the pressing part (45) is arranged in an inner cavity of a protrusion (25) protruding inwards on the cover body (2), a first pressure spring (44) is sleeved on the rod portion, and the first pressure spring (44) is held between a wall of the inner cavity of the protrusion (25) and the pressing part (45).

4. The lamp head cover of a bracket lamp as in claim 3, wherein the touch button (4) further comprises a screw (41) connected in the rod portion of the pressing part (45), the third metallic contact plate (6), a second pressure spring (42), and a cushion ring (43) are sleeved on a screw rod successively, an inner diameter of the cushion ring (43) is less than an outer diameter of the rod portion of the pressing part (45), and the second pressure spring (42) is set with a pretightening force.

5. The lamp head cover of a bracket lamp as in claim 4, wherein the shape of the inner cavity of the protrusion (25) is matched with an outer surface (46) of the pressing part (45).

6. The lamp head cover of a bracket lamp as in claim 5, wherein the third metallic contact plate (6), the second pressure spring (42), and the cushion ring (43) are movably sleeved on the screw rod.

7. The lamp head cover of a bracket lamp as in claim 6, wherein the number of metallic needles (1) is two.

8. The lamp head cover of a bracket lamp as in claim 7, wherein first and second lateral columns (21, 22) opposite each other and a third lateral column (23) are arranged inside the cover body (2), the metallic needles (1) are arranged in the first and second lateral columns (21, 22), two ends (31) of the first metallic contact plate (3) are bent and are connected to corresponding lateral columns respectively, and the second metallic contact plate (5) is arranged at a rear end of the third lateral column (23).

9. The lamp head cover of a bracket lamp as in claim 8, wherein the second metallic contact plate (5) is connected to an electrode of ballast in a lamp tube.

10. The lamp head cover of a bracket lamp as in claim 9, further comprising a fourth lateral column (24), opposite the third lateral column (23), wherein a middle portion (32) of the first metallic contact plate (3) is headed by the fourth lateral column (24).

11. The lamp head cover of a bracket lamp as in claim 10, characterized in that, the outer surface (46) of the pressing part (45) is a smooth cambered surface.

12. A lamp tube of a bracket lamp, wherein a lamp head cover is arranged at each of two ends of the lamp tube, the lamp head cover comprises a cover body (2) and metallic needles (1) passing through the cover body (2), a front end of the metallic needle (1) extends outside the cover body, a rear end of the metallic needle (1) is located inside the cover body, the rear end of the metallic needle (1) is fixedly connected to a first metallic contact plate (3), a second metallic contact plate (5) separated from the first metallic contact plate (3) is further comprised inside the cover body (2), the second metallic contact plate (5) is connected to an electrode of ballast in the lamp tube, a third metallic contact plate (6) is further arranged between the first metallic contact plate (3) and the second metallic contact plate (5), the third metallic contact plate (6) is connected to a touch button (4), the touch button (4) is exposed outside the cover body, and when the touch button (4) is pressed, the first metallic contact plate (3) and the second metallic contact plate (5) are electrically connected through the third metallic contact plate (6).

* * * * *